US005774036A

United States Patent [19]

Hrytzak et al.

[11] Patent Number: 5,774,036

[45] Date of Patent: Jun. 30, 1998

[54] BOBBIN-MOUNTED SOLENOID COIL AND METHOD OF MAKING

[75] Inventors: Bernard J. Hrytzak; Victor Derbowka, both of Chatham, Canada

[73] Assignee: Siemens Electric Limited, Ontario, Canada

[21] Appl. No.: 497,679

[22] Filed: Jun. 30, 1995

[51] Int. Cl.[6] ..... H01F 27/29; H01F 27/30

[52] U.S. Cl. ..... 336/192; 336/198; 336/208; 336/205; 336/185

[58] Field of Search ..... 336/192, 205, 336/185, 65, 198, 208; 242/440.1

[56] References Cited

U.S. PATENT DOCUMENTS

| | | | |
|---|---|---|---|
| 3,979,615 | 9/1976 | Neff | 310/71 |
| 4,026,013 | 5/1977 | Hughes | 29/628 |
| 4,251,911 | 2/1981 | Reynolds et al. | 29/605 |
| 4,318,069 | 3/1982 | Morse | 336/192 |
| 4,462,016 | 7/1984 | Bland et al. | 336/192 |
| 4,924,200 | 5/1990 | Kitahara et al. | 336/65 |
| 5,281,942 | 1/1994 | Stokes | 336/192 |
| 5,426,410 | 6/1995 | Niimi | 336/192 |

FOREIGN PATENT DOCUMENTS

| | | | |
|---|---|---|---|
| 0 103 373 | 3/1984 | European Pat. Off. . | |
| 0 212 812 | 3/1987 | European Pat. Off. . | |
| 3-268310 | 11/1991 | Japan | 336/192 |
| 4-43615 | 2/1992 | Japan | 336/192 |
| 2 050 066 | 12/1980 | United Kingdom | 336/192 |
| WO 94/00857 | 1/1994 | WIPO . | |

OTHER PUBLICATIONS

Seven–page European Search Report, PCT/CA96/00437 dated Oct. 2, 1996.

*Primary Examiner*—Michael L. Gellner
*Assistant Examiner*—Anh Mai

[57] ABSTRACT

A non-metallic bobbin (22) has features on a radial flange (28) which allow magnet wire (MW) that forms an electromagnet coil (114) on the bobbin core (24) to be tensioned throughout. An end segment of magnet wire is wrapped around a post (56) on the bobbin flange, and the magnet wire runs in tension generally diametrically across the bobbin to pass through slots (66, 68) in opposite walls of an electric-terminal-receiving socket (60) also on the flange. The wire runs in grooved tracks (74, 70) proximate the socket to pass around the perimeter edge of the flange to the opposite flange face where it is wound in tensioned convolutions around the core to create the coil. It then runs in tension from the coil around the perimeter edge of the flange to pass through a second socket (62) having the same associated features as the first socket (60). From there the tensioned magnet wire extends back across the bobbin to be tied to the post. Terminals (84, 86) are then inserted into the sockets to connect to the magnet wire and maintain wire tension. The post and groove tracks (74, 76) associated with a respective socket are then severed from the bobbin, also severing those portions of the wire that extended from the sockets to the post.

32 Claims, 7 Drawing Sheets

BOBBIN-MOUNTED SOLENOID COIL AND METHOD OF MAKING

FIELD OF THE INVENTION

This invention relates generally to bobbin-mounted solenoid coils and methods of making them.

BACKGROUND AND SUMMARY OF THE INVENTION

It is a common practice to make a solenoid coil assembly by winding a length of magnet wire on a nonmagnetic bobbin to form an electromagnet coil and establishing electrical connection of end portions of the wire with respective electrical terminals that are mounted on the bobbin. Application of voltage across the terminals creates current flow in the coil that results in the creation of magnetic flux symbolized by endless lines of flux that envelope the coil in a generally toroidal pattern. Such solenoid coil assemblies are commonly used in electromagnetic-actuated valves to control the opening and closing of the valves.

Such valves typically include ferromagnetic stator structure that envelopes the bobbin-mounted coil to provide a magnetic circuit path for concentrating the magnetic flux. A small air gap is present in the stator structure within a central through-hole that extends axially through the bobbin's core, or at least immediately proximate such through-hole. A ferromagnetic armature is disposed proximate the air gap so that the magnetic circuit flux passes through a portion of the armature as it passes across the air gap. As a result, an axial component of magnetic force is exerted on the armature in one axial direction for operating the valve, typically against a counter force provided by a spring that acts to urge the armature in the opposite axial direction. If the spring normally biases the valve closed when there is no current flow in the coil, increasing current flow in the coil will typically increase the amount of valve opening.

In automotive vehicle applications there are a number of valves that utilize such bobbin-mounted solenoid coils. Two examples, among others, are canister purge solenoid valves and exhaust gas recirculation valves. Because of increasingly stricter regulations pertaining to vehicle tailpipe and hydrocarbon emissions, it is becoming increasingly important that such valves be capable of exercising more precise control. While various control strategies may accomplish more precise control, they may be limited by the construction of the particular solenoid-actuated valve that is involved. An improved construction of a solenoid coil assembly of such a valve is one means for allowing more accurate control strategies to be successfully implemented.

In one respect, the present invention relates to an improved construction for such a solenoid coil assembly. More specifically, the invention provides a solenoid coil assembly in which are tensioned, not only the convolutions of the magnet wire wound around the core of the bobbin, but also the end segments of the magnet wire extending from the convoluted coil to respective bobbin-mounted electrical terminals to which the respective end segments of the magnet wire are electrically joined. By utilizing the tensioning technique of the present invention in conjunction with "precision winding" of the magnet wire to form the coil, the magnetic flux vs. electric current characteristic of a bobbin-mounted electromagnet coil can be accurately established.

Mass-production manufacture and assembly of automotive vehicle components parts must be cost-effective in order to be commercially viable. This usually requires that such parts be suited for automated fabrication and assembly methods.

In another respect, the present invention relates to a method of making a bobbin-mounted solenoid coil that is well-suited for cost-effective automated fabrication using essentially conventional manufacturing equipment and techniques. This capability is due in large part to certain constructional features of the bobbin.

Briefly, the invention, in a presently preferred embodiment, comprises a bobbin that is fabricated by conventional injection molding techniques to provide means for tensioning end segments of the magnet wire and establishing electrical connection of the respective tensioned end segments with respective electrical terminals in such a way that in the finished bobbin-mounted solenoid coil, the tension is maintained not only in the convolutions of the coil, but also in those portions of the end segments that extend from the terminals to the coil. The tensioning and winding of the magnet wire on the bobbin in accordance with the inventive principles can be performed by conventional equipment adapted to achieve the cost-effective automated fabrication of the inventive bobbin-mounted coil assemblies. Assembly of the electrical terminals to the end segments of the bobbin-mounted coil can be performed entirely mechanically by simple insertion operations.

Further features, advantages, and benefits of the invention will be seen in the ensuing description and claims that are accompanied by drawings. The drawings disclose a presently preferred embodiment of the invention according to the best mode contemplated at this time for carrying out the invention.

DESCRIPTION OF THE PREFERRED EMBODIMENT

FIGS. 1–8 show a bobbin 22 that is used in making a solenoid coil assembly. The bobbin is preferably an injection-molded plastic that possesses dimensional stability over a range of temperature extremes that are typically encountered in automotive engine usage.

Figure 1:
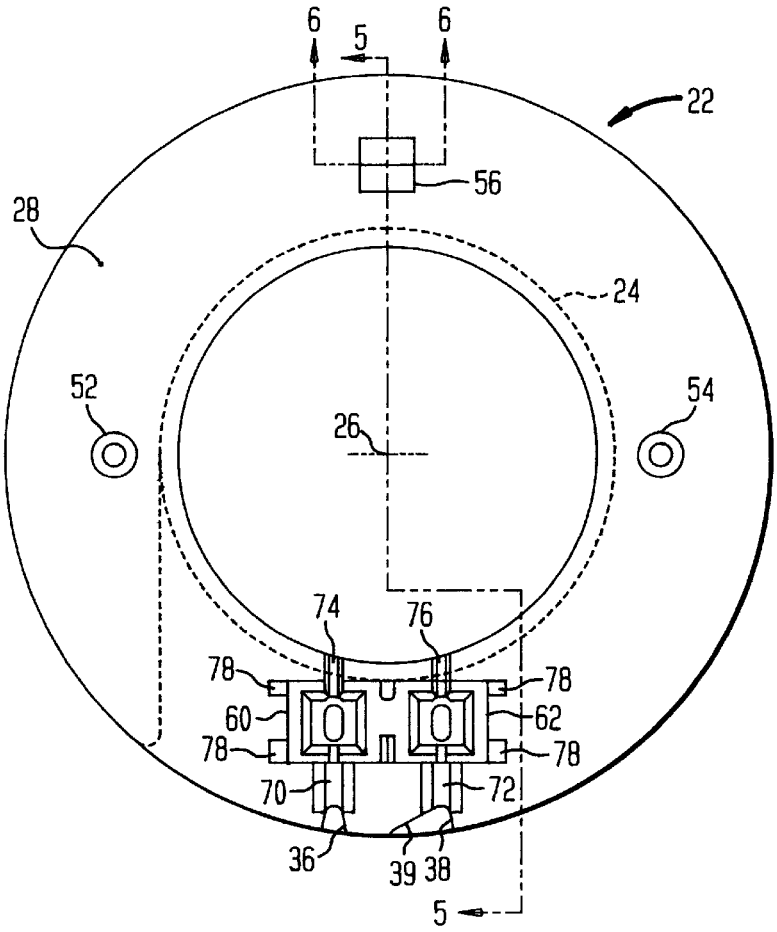
FIG. 1 is top plan view of a bobbin embodying principles of the invention.
Figure 2:
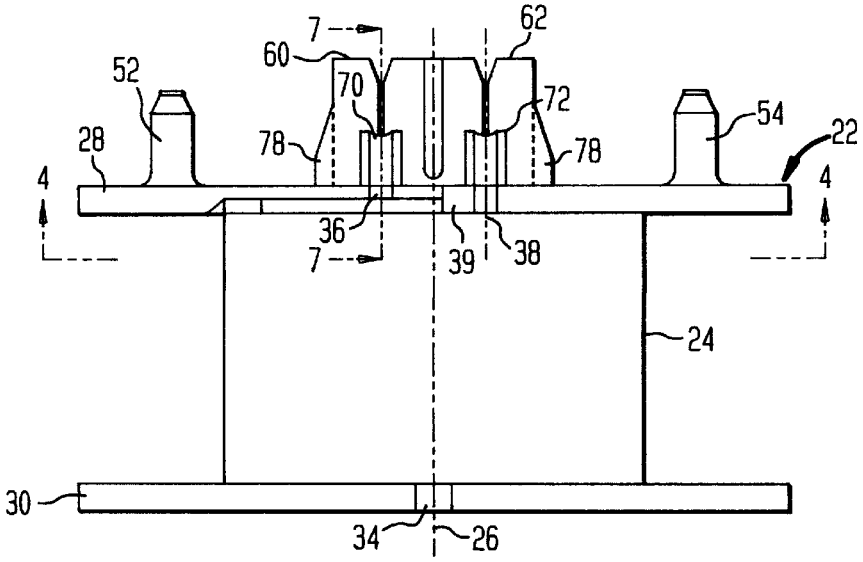
FIG. 2 is a front elevation view of FIG. 1.
Figure 3:
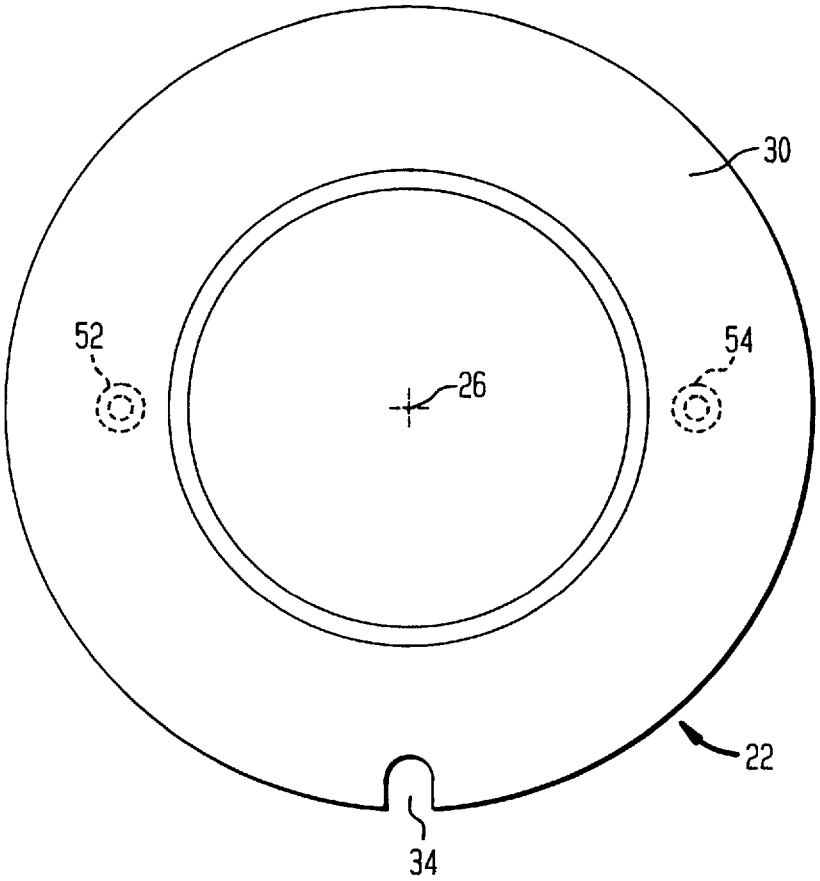
FIG. 3 is a bottom plan view of FIG. 2.
Figure 4:
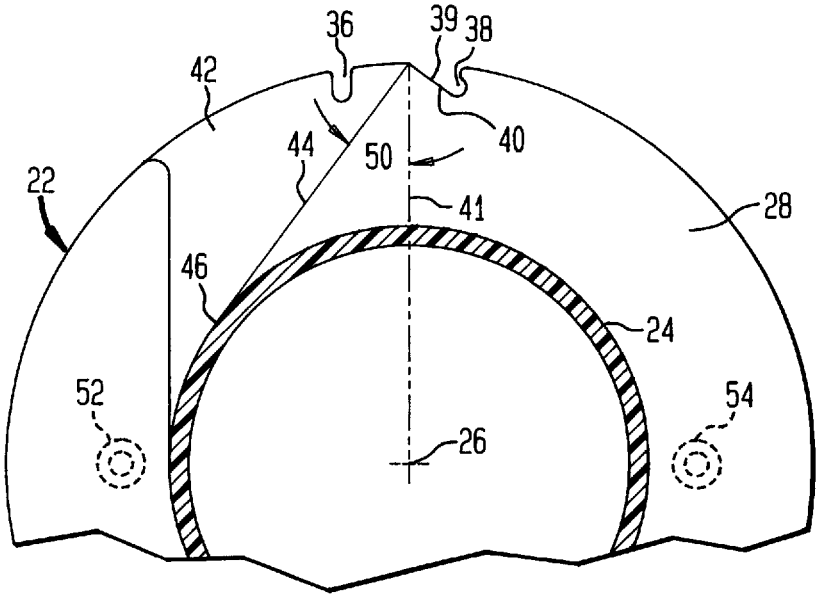
FIG. 4 is a fragmentary cross sectional view as taken in the direction of arrows 4—4 in FIG. 2.
Figure 5:
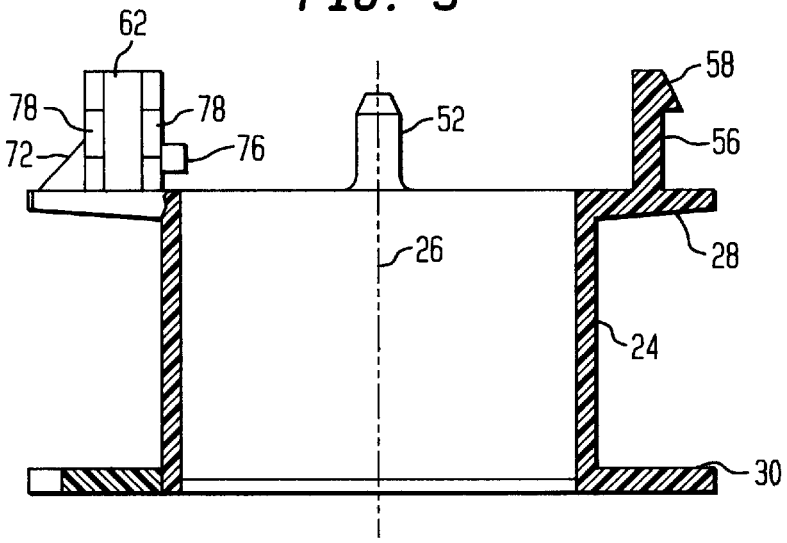
FIG. 5 is a cross sectional view as taken in the direction of arrows 5—5 in FIG. 1.
Figure 6:
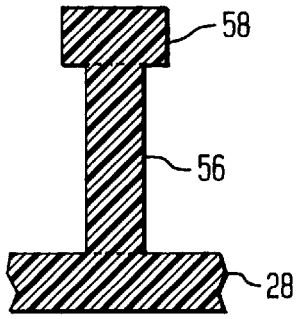
FIG. 6 is a fragmentary view, on an enlarged scale, as taken in the direction of arrows 6—6 in FIG. 1.
Figure 7:
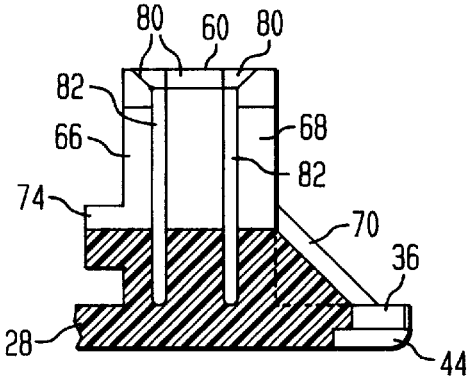
FIG. 7 is an enlarged cross sectional view as taken in the direction of arrows 7—7 in FIG. 2.
Figure 8:
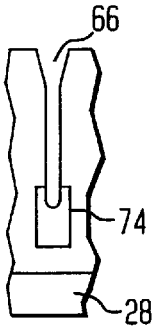
FIG. 8 is a full left side view of FIG. 7.

Bobbin 22 comprises a straight cylindrical tubular core 24 coaxial with a main longitudinal axis 26, and upper and lower flanges 28 and 30 at the opposite axial ends of core 24. As will be explained in conjunction with later drawing FIGS., a length of magnet wire is wound on core 24 between flanges 28, 30 to form an electromagnet coil on bobbin 22. Lower flange 30 has a circular shape whose outer perimeter is interrupted at one location by a small inwardly extending slot 34. Upper flange 28 also has a circular shape, but its outer perimeter is interrupted by two closely adjacent slots 36 and 38 that have somewhat different shapes. Slot 36 is basically U-shaped. One side of slot 38 is slightly more than a half-U-shape while the other side 39 runs along a straight line extending from a point of tangency 40 with the first side at about 55 degrees to a radial 41 to where it meets the circular outer perimeter of the flange. The lower face of flange 28 comprises shallow recess 42 that is seen in FIG. 4 to be somewhat triangularly shaped. Shallow recess 42 comprises an edge surface 44 that extends from a point of tangency 46 with the O.D. of core 24 to a location on the perimeter of flange 28 that is between slots 38 and 36. Edge surface 44 makes an angle 50 with radial 41 that is approximately 35 degrees.

The upper face of flange 28 contains two upstanding cylindrical posts 52 and 54 that are diametrically opposite each other and equidistant from axis 26 and whose upper ends are tapered. At 90 degrees to both posts 52, 54 is a further upright post 56 having a generally rectangular shape with a radially outwardly projecting overhang 58 at its top that is also slightly wider in the circumferential sense about axis 26 than is that portion of the post below the overhang.

Generally diametrically opposite post 56 on the upper face of flange 28 are a pair of upright, side-by-side, walled sockets 60 and 62. Each socket is adapted for receiving a respective electrical terminal like the one depicted in FIGS. 9–12 (to be described in detail later) and to provide for the electrical connection of a respective terminal with a respective end segment of a magnet wire wound on bobbin 22.

Each socket has a generally rectangular wall that is open at the top for insertion of an electric terminal. Each socket is disposed to an opposite circumferential side of an imaginary diameter that extends across the bobbin from post 56. The opposed radially inner and radially outer portions of each socket wall contain straight narrow slots 66 and 68 respectively that are in parallel and mutual alignment across the respective socket. The slots are open at the top where they have a lead that facilitates the passage of respective segments of the coil magnet wire into the slots, as will be explained in greater detail later on. A respective grooved track 70 and 72 ramps upwardly from a respective slot 36, 38 to the bottom of the radially outer slot 68 of a respective socket 60, 62. A respective short grooved track 74 and 76 is provided on the radially inner wall of the respective socket 60, 62 slightly above the upper face of flange 28, each track 74, 76 having a groove that extends from the bottom of the radially inner slot 66 of the respective socket 60, 62 toward the open center of the bobbin as viewed in plan. Integral formations 78 serve to rigidify the sockets to flange 28. The upper rectangular rim of each socket has a chamfer 80 to facilitate terminal insertion, and each socket has shallow axial grooves 82 proximate its four corners.

Figure 9:
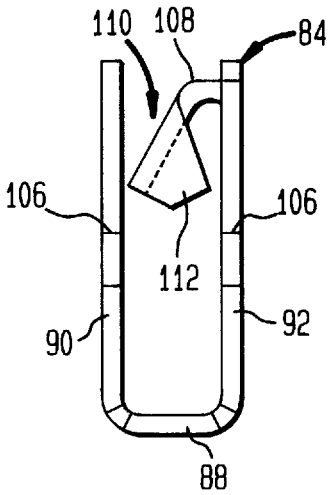
FIG. 9 is a front elevation view of an electrical terminal shown by itself prior to association with the bobbin.
Figure 10:
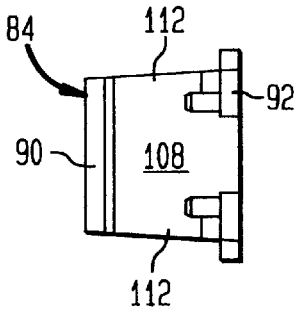
FIG. 10 is a top plan view of FIG. 9.
Figure 11:
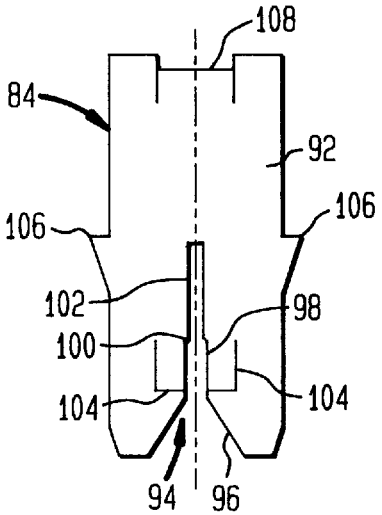
FIG. 11 is a right side elevation view of FIG. 9.
Figure 12:
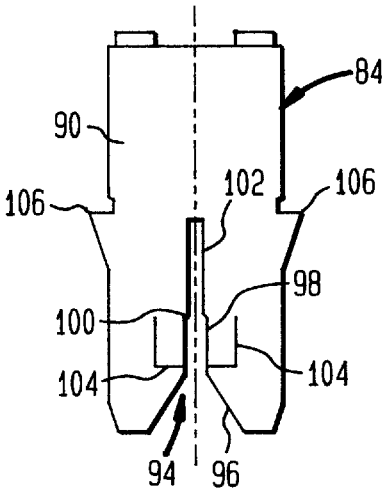
FIG. 12 is a left side elevation view of FIG. 9.

FIGS. 9–12 illustrate an electric terminal 84 prior to its insertion into a respective one of the sockets 60, 62. A like electric terminal 86 (FIGS. 17 and 18) is inserted into the other socket. Terminal 84 is fabricated as a single piece from flat strip stock to comprise a generally U-shaped body having a base 88 whose opposite ends join with flat sides 90 and 92 respectively along 90 degree radii, as shown by FIG. 9. Each side contains a centrally located axial slot 94 that is open at base 88 and extends upwardly therefrom for about one-half the overall axial length of the side. At base 88, a slot 94 comprises an entrance lead 96 that extends to a straight section 98 which in turn extends via a tapered section 100 to a narrower straight section 102. The material is slit, as shown at 104 in FIGS. 11 and 12, adjacent each side of section 98. The outer edges of sides 90, 92 contain pointed retention barbs 106. A somewhat T-shaped tab 108 inclines downwardly and inwardly from the central portion of the top edge of side 92, stopping short of the opposite side 90 to provide an insertion space 110 for a mating terminal (not shown). The wings 112 of the T-shape are curled back toward, but stop short of, side 92.

Figure 13:
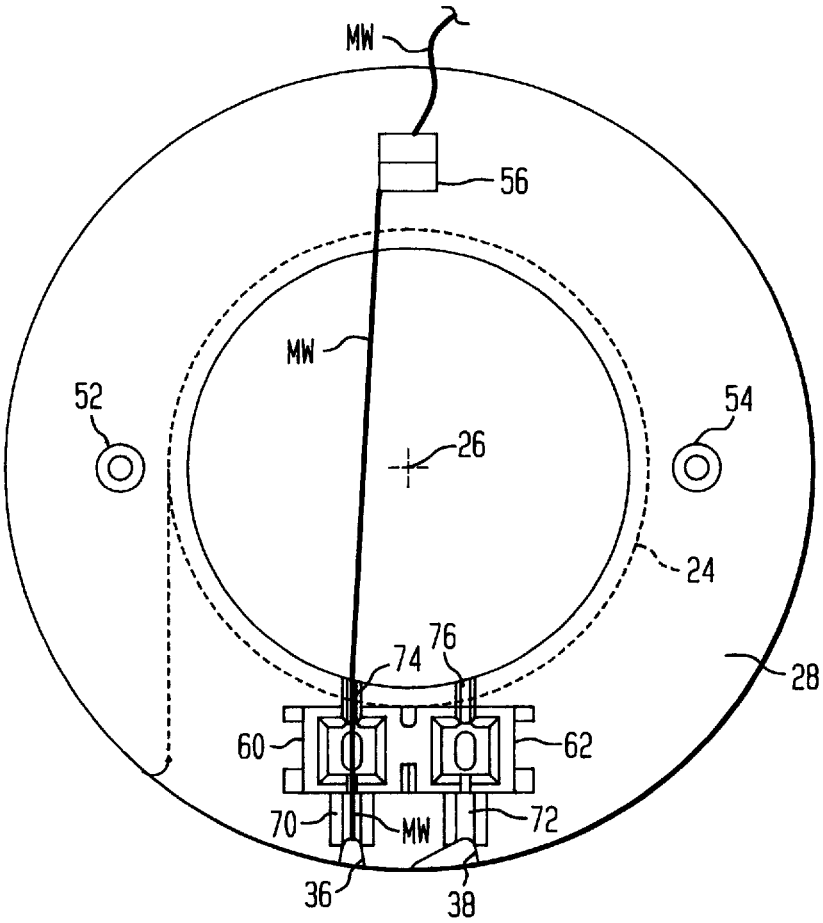
FIG. 13 is view similar to FIG. 1 illustrating a step in the method of making an electromagnet coil assembly using the bobbin of FIG. 1.

The method of fabricating a bobbin-mounted solenoid coil assembly will now be explained with reference to FIGS. 13–19. As shown by FIG. 13, magnet wire MW is tightly wrapped around post 56 below overhang 58. It is then brought across the bobbin to run in and along the groove of track 74, thence pass through slot 66 of socket 60 and across the socket's interior to exit the socket by passing through slot 68. From slot 68 the magnet wire runs in and along the groove of ramped track 70 to enter slot 36 where it loops around the edge of the slot to the bottom face of flange 28.

Figure 14:
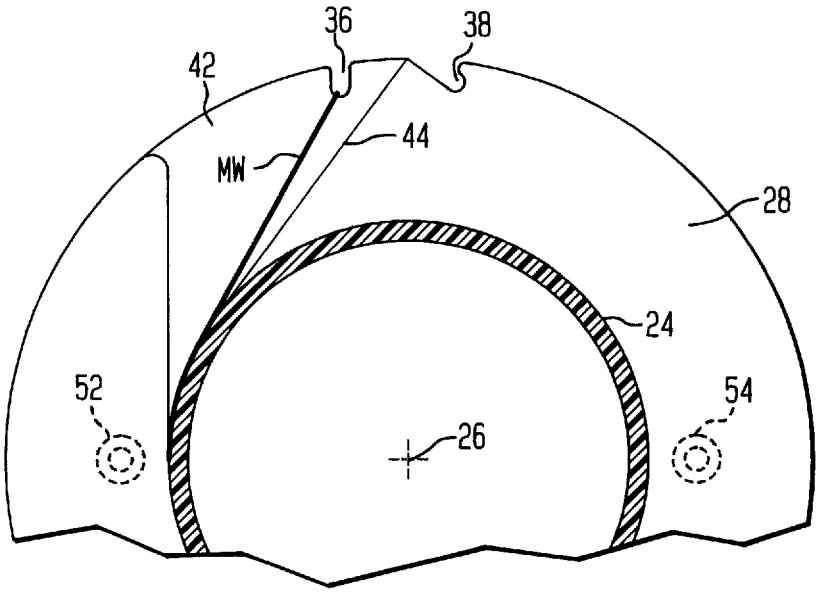
FIG. 14 is view similar to FIG. 4 illustrating a further step in the method of making the electromagnet coil assembly.
Figure 15:
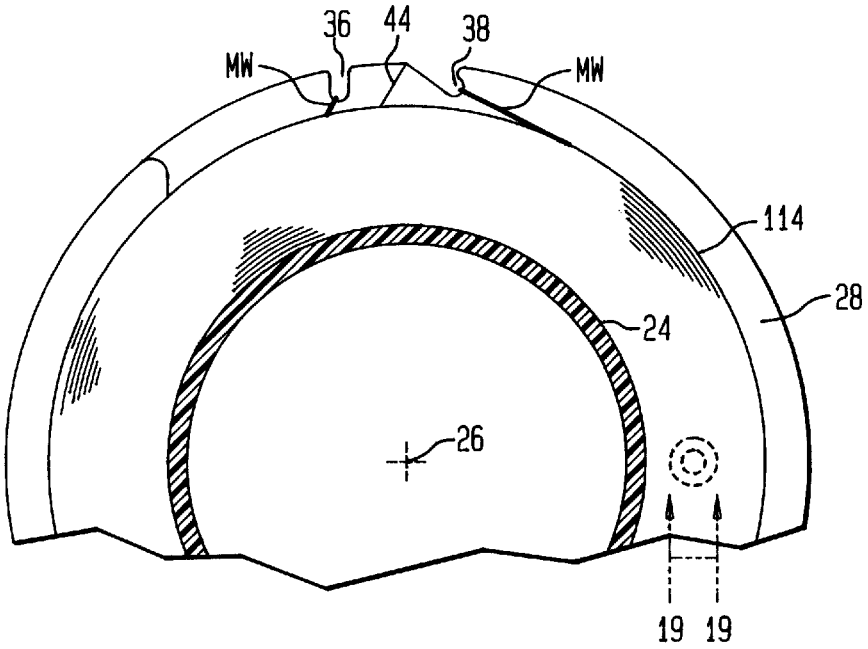
FIG. 15 is view similar to FIG. 4 illustrating a still further step in the method of making the electromagnet coil assembly.

FIG. 14 shows the magnet wire extending within recess 42 from the edge of slot 36 to tangency with core 24 where it begins to form convolutions around the core between flanges 28, 30 to ultimately create an electromagnet coil 114, as shown in FIG. 15. The latter FIG. further shows the magnet wire extending from the final convolution of the coil to slot 38 where the magnet wire loops around the edge of the slot to the upper face of flange 28.

Figure 16:
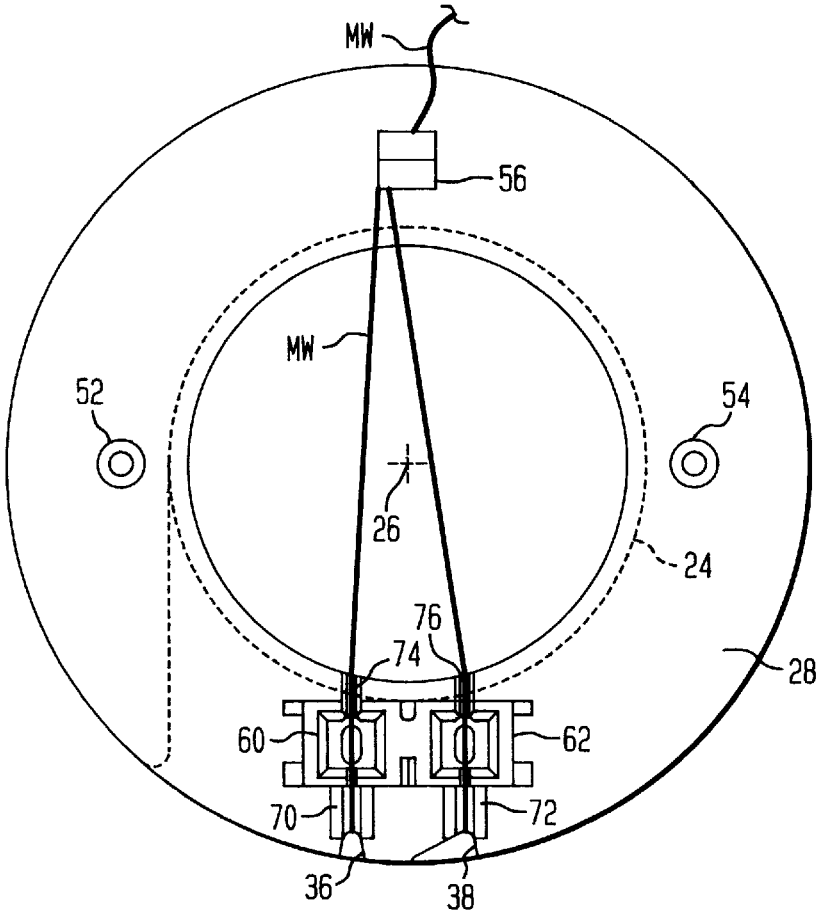
FIG. 16 is view similar to FIG. 1 illustrating a still further step in the method of making the electromagnet coil assembly.

FIG. 16 shows the magnet wire extending from slot 38 to run in and along the groove in ramped track 72 and thence enter socket 62 by passing through slot 68 of that socket. The magnet wire passes across the interior of the socket, exiting via slot 66 to run in and along the groove in track 76. Upon leaving track 76, the magnet wire extends across the bobbin to an end segment of the magnet wire that is wrapped, or tied, securely around post 56.

At all times during the running of the magnet wire on the bobbin, it is kept tensioned so that not only are the coil convolutions tensioned, but also the segments that extend from coil 114 to post 56.

Figure 17:
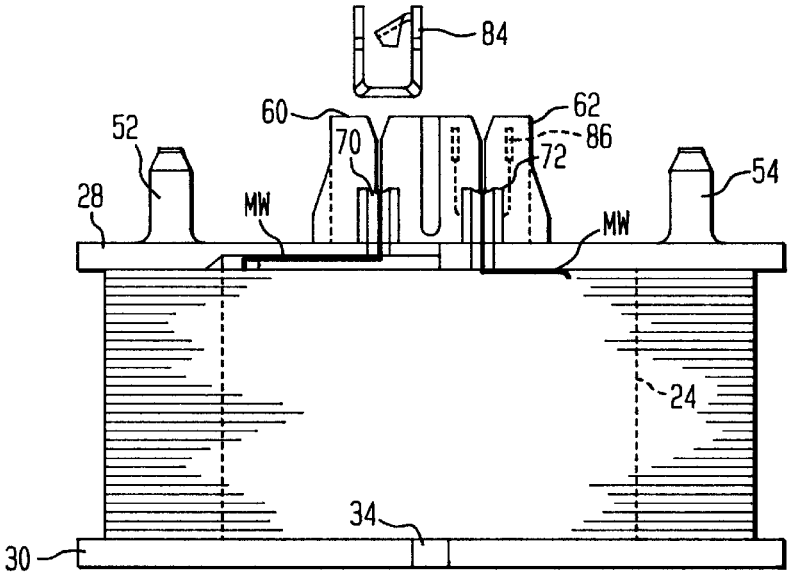
FIG. 17 is view similar to FIG. 2 illustrating a still further step in the method of making the electromagnet coil assembly.

Terminals 84, 86 are then assembled by aligning each with the open end of a respective socket 60, 62 and forcefully inserting them into the sockets. Although FIG. 17 shows terminal 86 inserted into socket 62 and terminal 84 poised for insertion into socket 60, it is more efficient to simultaneously insert both terminals into their sockets.

As a terminal is being inserted into a socket, the portion of the magnet wire spanning the interior of the socket enters slots 94. Leads 96 facilitate entry into the narrow portions of the slots. When the terminal has been fully inserted, the magnet wire is lodged in section 102 in electric contact with the terminal. Each slot is dimensioned in relation to the diameter of the magnet wire to scrape away the thin insulation covering the magnet wire so that the electric contact is thereby established. Barbs 106 embed slightly into the wall of the socket to securely retain the terminal in the socket. The tensioned magnet wire running across the interior of each socket is also wedged in the terminal slots so that the magnet wire is maintained in tension.

Figure 18:
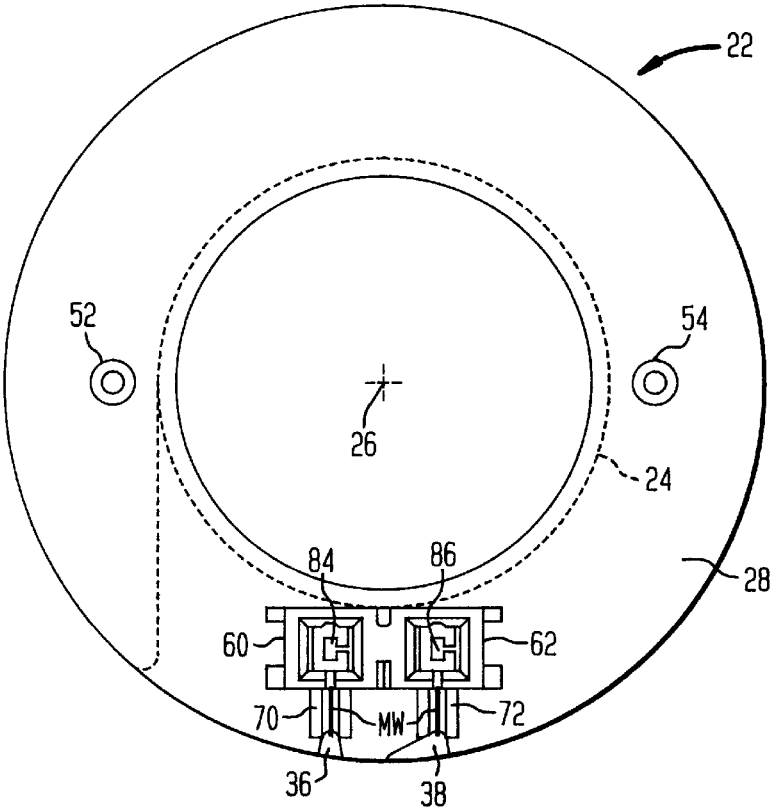
FIG. 18 is view similar to FIG. 1 illustrating a still further step in the method of making the electromagnet coil assembly.

The process is completed by severing, or shearing, both tracks 74, 76 at the location where they join their respective sockets, severing the magnet wire in the process, and by shearing post 56 from flange 28 at the base of the post. The finished condition is shown by FIG. 18.

Figure 19:
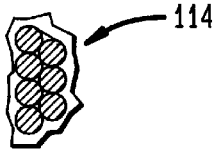
FIG. 19 is a fragmentary cross sectional view, on an enlarged scale, as taken in the direction of arrows 19—19 in FIG. 15.

By "precision winding" of coil 114, as shown in FIG. 19, maximum convolutions are placed in minimum space, and they are accurately located so that the electromagnetic characteristics of the coil are accurately defined.

The two posts 54, 56 provide for mounting of the bobbin-mounted coil directly on an associated stator structure (not shown). Such stator structure comprises a ferromagnetic pole piece having a radial flange containing a central axial opening that is concentric with axis 26 and two through-holes spaced radially outwardly therefrom. The upper face of flange 28 is disposed flat against the lower face of the pole piece flange with posts 54, 56 extending through the respective through-holes in the pole piece flange. The tapered ends of the posts are then deformed by any suitable plastic deformation process to create mushroom heads that bear against the upper face of the pole piece flange.

While the foregoing has described a preferred embodiment of bobbin-mounted coil and method of making it, it is to be appreciated that the inventive principles may be practiced in any form that falls within the scope of the following claims.

What is claimed is:

1. An electromagnetic device comprising a length of insulated electric wire, and structure on which an intermediate segment of the length of wire is disposed as electromagnetic coil that terminates in end segments of the length of wire, the structure comprising a wall defining a socket having an open axial end for accepting an electric terminal that is to make electric contact with one of the end segments of the wire, wire guides mutually aligned across the socket for locating the one end segment of the wire to transversely span the socket, and a wire securement which is disposed on the structure in spaced relation to the socket wall and to which the one wire end segment is secured, wherein the one wire end segment extends along a straight line in tension across the socket and continues along a straight line in tension from a wire guide to the wire securement, the structure comprises a surface on which the wire securement and the socket wall are disposed, wherein the wire securement is in general alignment with the wire guides, and in which a second wall defining a second socket having an open axial end for accepting a second electric terminal that is to make electric contact with the other end segment of the wire is disposed on the surface in spaced relation to the wire securement, and wherein the other end segment of the wire extends along a straight line in tension across the second socket and continues along a straight line in tension from a wire guide of the second socket to the wire securement.

2. A device as set forth in claim 1 in which said wire securement comprises a single post disposed on the surface, and the two sockets are disposed to a respective side of an imaginary straight line extending from said post.

3. A device as set forth in claim 2 in which the wire guides of each of said sockets comprise respective slots in respective opposite portions of each socket wall, each said slot extending axially in the respective wall portion from said open axial end of the respective socket.

4. A device as set forth in claim 3 in which each said slot ends at a location that is spaced axially from said surface, and said wire guides further comprise respective grooved tracks external to said walls of said sockets extending away from the respective opposite portions of each socket wall and having a respective groove extending from a respective slot.

5. A device as set forth in claim 4 in which one of said grooved tracks extending from each socket wall extends to a respective slot in an edge of said surface and is inclined from the respective socket wall to said surface.

6. A device as set forth in claim 4 in which one of said grooved tracks extending from each socket wall extends generally parallel to, and spaced axially from, said surface.

7. An electromagnetic device comprising a length of insulated electric wire, and structure on which an intermediate segment of the length of wire is disposed as electromagnetic coil that terminates in end segments of the length of wire, the structure comprising a wall defining a socket having an open axial end for accepting an electric terminal that is to make electric contact with one of the end segments of the wire, wire guides mutually aligned across the socket for locating the one end segment of the wire to transversely span the socket, and a wire securement which is disposed on the structure in spaced relation to the socket wall and to which the one wire end segment is secured, wherein the one wire end segment extends along a straight line in tension across the socket and continues along a straight line in tension from a wire guide to the wire securement, and in which said wire guides comprise respective slots in respective opposite portions of such socket wall, each said slot extending axially in the respective wall portion from said open axial end of the socket.

8. A device as set forth in claim 7 in which said structure comprises a surface on which the wire securement and the socket wall are disposed, each said ends at a location that is spaced axially from said surface, and said wire guides further comprise respective grooved tracks external to said socket and extending away from respective opposite portions of the socket wall and having a respective groove extending from a respective slot.

9. A device as set forth in claim 8 in which one of said grooved tracks extending from the socket wall extends to said surface and is inclined from the respective socket wall to said surface, and in which another of said grooved tracks extends in axially spaced parallel relation to said surface.

10. An electromagnetic device comprising a length of insulated electric wire, and structure on which an intermediate segment of the length of wire is disposed as electromagnetic coil that terminates in end segments of the length of wire, the structure comprising a wall defining a socket having an open axial end for accepting an electric terminal that is to make electric contact with one of the end segments of the wire, wire guides mutually aligned across the socket for locating the one end segment of the wire to transversely span the socket, and a wire securement which is disposed on the structure in spaced relation to the socket wall and to which the one wire end segment is secured, wherein the one wire end segment extends along a straight line in tension across the socket and continues along a straight line in tension from a wire guide to the wire securement.

11. A device as set forth in claim 10 wherein the structure comprises a surface on which the wire securement and the socket wall are disposed, and wherein the wire securement is in general alignment with the wire guides.

12. A device as set forth in claim 10 wherein the structure comprises a bobbin that comprises a central tubular core having an imaginary longitudinal axis and a radial flange directed outwardly from the core, the flange having opposite axial facing surfaces one of which faces toward a portion of the core around which the electromagnetic coil is disposed and the other of which is opposite the one surface, the socket wall and the wire securement being disposed on the other surface.

13. A device as set forth in claim 12 wherein the wire securement is in general alignment with the wire guides.

14. A device as set forth in claim 13 in which a second wall defining a second socket having an open axial end for accepting a second electric terminal that is to make electric contact with the other end segment of the wire is disposed on the other surface in spaced relation to the wire securement, second wire guides mutually aligned across the second socket for locating the other end segment of the wire to transversely span the second socket, and wherein the other end segment of the wire extends along a straight line in tension across the second socket and continues along a straight line in tension from a wire guide of the second socket to the wire securement.

15. A device as set forth in claim 14 in which the wire securement comprises a single post disposed on the other surface, and the two sockets are disposed to a respective side of an imaginary straight line extending from the post.

16. A device as set forth in claim 15 in which the wire guides of each of the sockets comprise respective slots in respective opposite portions of each socket wall, each slot extending axially in the respective wall portion from the open axial end of the respective socket.

17. A bobbin-mounted solenoid coil comprising a bobbin and a length of magnet wire comprising convolutions extending around said bobbin to form an electromagnet coil: said bobbin comprising;

a central tubular cylindrical core disposed concentric with an imaginary longitudinal axis and having a radial flange directed outwardly from said core, said flange having opposite axial faces one of which faces toward that portion of said core around which convolutions of the magnet wire are disposed and the other of which is opposite said one face, electric terminal mounting means on said other face providing for at least one electric terminal to be mounted thereon, guide means for guiding passage of magnet wire across said electric terminal mounting means and said flange to said one face, and magnet wire securement means disposed on said flange in general alignment with said guide means, to one side of an imaginary bobbin diameter, said electric terminal mounting means being disposed to the other side of said imaginary bobbin diameter such that an imaginary straight line between said guide means and said magnet wire securement means passes across said central tubular cylindrical core and said imaginary bobbin diameter; and said magnet wire comprising an end segment secured to said magnet wire securement means and extending in tension from said magnet wire securement means, through said guide means in tension to said one face, and thence in tension to said coil.

18. A bobbin-mounted solenoid coil as set forth in claim 17 in which said electric terminal mounting means comprises two walled terminal-receiving sockets which are disposed circumferentially adjacent and each of which is open at an axial end for receiving a respective electrical terminal, and said guide means comprises respective slots in respective opposite wall portions of each socket, each said slot extending axially in the respective wall portion from said open axial end of the respective socket, and said magnet wire runs in tension across each of said sockets between said opposite wall portions of the respective socket.

19. A bobbin-mounted solenoid coil as set forth in claim 18 further including two electric terminals, each disposed in a respective one of said sockets and comprising means making contact with said magnet wire to establish both electric continuity between the magnet wire and the electric terminal and to prevent movement of the magnet wire within the socket so that tension is maintained in the magnet wire.

20. An electromagnetic device comprising a length of insulated electric wire, and structure on which an intermediate segment of the length of wire is disposed as electromagnetic coil that terminates in end segments of the length of wire, the structure comprising a wall defining a socket having an open axial end for accepting an electric terminal that is to make electric contact with one of the end segments of the wire, wire guides mutually aligned across the socket for locating the one end segment of the wire to transversely span the socket, and a wire securement which is disposed on the structure in spaced relation to the socket wall and to which the one wire end segment is secured, wherein the one wire end segment extends along a straight line in tension across the socket and continues along a straight line in tension from a wire guide to the wire securement, wherein the structure comprises a bobbin that comprises a central tubular core having an imaginary longitudinal axis and a radial flange directed outwardly from the core, the flange having opposite axial facing surfaces, one of which faces toward a portion of the core around which the electromagnetic coil is disposed and the other of which is opposite the one surface, the socket wall and the wire securement being disposed on the other surface, wherein the wire securement is in general alignment with the wire guides, in which a second wall defining a second socket having an open axial end for accepting a second electric terminal that is to make electric contact with the other end segment of the wire is disposed on the other surface in spaced relation to the wire securement second wire guides mutually aligned Across the second socket for locating the other end segment of the wire to transversely span the second socket, and wherein the other end segment of the wire extends along a straight line in tension across the second socket and continues along a straight line in tension from a wire guide of the second socket to the wire securement, in which the wire securement comprises a single post disposed on the other surface, and the two sockets are disposed to a respective side of an imaginary straight line extending from the post, in which the wire guides of each of the sockets comprise respective slots in respective opposite portions of each socket wall, each slot extending axially in the respective wall portion from the open end of the respective socket, and in which each slot ends at a location that is spaced axially from the other surface, and the wire guides further comprise respective grooved tracks external to the walls of the sockets extending away from the respective opposite portions of each socket wall and having a respective groove extending from a respective slot.

21. A device as set forth in claim 20 in which one of the grooved tracks extending from each socket wall extends to a respective slot in an edge of the flange and is inclined from the respective socket wall to the other surface.

22. A device as set forth in claim 20 in which one of the grooved tracks extending from each socket wall extends generally parallel to, and spaced axially from, the other surface.

23. An electromagnetic device comprising a lath of insulated electric wire, and structure on which an intermediate segment of the length of wire is disposed as electromagnetic coil that terminates in end segments of the length of wire, the structure comprising a wall defining a socket having an open axial end for accepting an electric terminal that is to make electric contact with one of the end segments of the wire, wire guides mutually aligned across the socket for locating the one end segment of the wire to transversely span the socket, and a wire securement which is disposed on the structure in spaced relation to the socket wall and to which the one wire end segment is secured, wherein the one wire end segment extends along a straight line in tension across the socket and continues along a straight line in tension from a wire guide to the wire securement, wherein the structure comprises a bobbin that comprises a central tubular core having an imaginary longitudinal axis and a radial flange directed outwardly from the core, the flange having opposite axial facing surfaces, one of which faces toward a portion of the core around which the electromagnetic coil is disposed and the other of which is opposite the one surface, the socket wall and the wire securement being disposed on the other surface, wherein the wire securement is in general alignment with the wire guides, and in which the wire guides comprise respective slots in respective portions of the socket wall, each slot extending axially in the respective wall portion from the open axial end of the socket.

24. A device as set forth in claim 23 in which each slot ends at a location that is spaced axially from the other surface, and the wire guides further comprise respective grooved tracks external to the socket and extending away from respective opposite portions of the socket wall and having a respective groove extending from a respective slot.

25. A device as set forth in claim 24 in which one of the grooved tracks extending from the socket extends to the other surface and is inclined from the respective socket wall portion to the other surface in spaced relation to the wire securement, and in which another of the grooved tracks extends in axially spaced parallel relation to the other surface.

26. A method of making a bobbin-mounted solenoid coil comprising:

providing a bobbin that comprises;

a central tubular cylindrical core disposed concentric with an imaginary longitudinal axis and having a radial flange directed outwardly from said core, said flange having opposite axial faces one of which faces toward that portion of said core around which convolutions of magnet wire are to be wound and the other of which is opposite said one face, electric terminal mounting means on said other face providing for two electric terminals to be mounted thereon, and guide means for guiding passage of magnet wire across said electric terminal mounting means and said flange to said one face, and magnet wire securement means disposed on said flange;

providing a length of magnet wire;

securing an end segment of said magnet wire to said magnet wire securement means;

running said magnet wire from said end segment in tension from said magnet wire securement means to and along a first portion of said guide means that extends across a first portion of said electric terminal mounting means to said one face of said flange, thence winding said magnet wire in tensioned convolutions onto said core to create an electromagnet coil, thence running said magnet wire in tension from said coil to and along a second portion of said guide means extending from said one face of said flange across a second portion of said electric terminal mounting means, and thence running and securing said magnet wire in tension to said magnet wire securement means; and then mounting respective electric terminals in respective portions of the electric terminal mounting means to establish electric conductivity between the tensioned magnet wire and the respective electric terminal.

27. A bobbin-mounted solenoid coil made by the method of claim 26.

28. A method of making a bobbin-mounted solenoid coil comprising:

providing a bobbin that comprises;

a central tubular cylindrical core disposed concentric with an imaginary longitudinal axis and having a radial flange directed outwardly from said core, said flange having opposite axial faces one of which faces toward that portion of said core around which convolutions of magnet wire are to be wound and the other of which is opposite said one face, electric terminal mounting means on said other face providing for two electric terminals to be mounted thereon, guide means for guiding passage of magnet wire across said electric terminal mounting means and said flange to said one face, and magnet wire securement means disposed on said flange;

providing a length of magnet wire;

securing an end segment of said magnet wire to said magnet wire securement means;

running said magnet wire from said end segment in tension from said magnet wire securement means to and along a first portion of said guide means that extends across a first portion of said electric terminal mounting means to said one face of said flange, thence winding said magnet wire in tensioned convolutions onto said core to create an electromagnet coil, thence running said magnet wire in tension from said coil to and alone a second portion of said guide means extending from said one face of said flange across a second portion of said electric terminal mounting means, and thence running and securing said magnet wire in tension to said magnet wire securement means, and further including the step of mounting two electric terminals on said electric terminal mounting means such that a first of said electric terminals makes contact with said magnet wire where said magnet wire extends across said first portion of said electric terminal mounting means to both establish electric continuity between the magnet wire and said first electric terminal and prevent movement of the magnet wire along said first portion of said guide means so that tension is maintained in said magnet wire along said first portion of said guide means and such that a second of said electric terminals makes contact with said magnet wire where said magnet wire extends across said second portion of said electric terminal mounting means to both establish electric continuity between the magnet wire and said second electric terminal and prevent movement of the magnet wire along said second portion of said guide means so that tension is maintained in said magnet wire along said second portion of said guide means.

29. A method as set forth in claim 28 in which said magnet wire securement means comprises a post disposed on said flange, and further including the step of removing said post from said flange after said electric terminals have been mounted on said electric terminal mounting means.

30. A method as set forth in claim 28 in which in which said first and second portions of said guide means comprise respective grooved tracks extending radially inwardly from said electric terminal mounting means in axially spaced relation to said flange, and further including the step of shearing said grooved tracks from said electric terminal mounting means after said electric terminals have been mounted on said electric terminal mounting means, and in the process severing said magnet wire running in each track.

31. A method of making a bobbin-mounted solenoid coil comprising:

providing a bobbin that comprises;

a central tubular cylindrical core disposed concentric with an imaginary longitudinal axis and having a radial flange directed outwardly from said core, said flange having opposite axial faces one of which faces toward that portion of said core around which convolutions of magnet wire are to be wound and the other of which is opposite said one face, electric terminal mounting means on said other face providing for two electric terminals to be mounted thereon, guide means for guiding passage of magnet wire across said electric terminal mounting means and said flange to said one face, and magnet wire securement means disposed on said flange;

providing a length of magnet wire;

securing an end segment of said magnet wire to said magnet wire securement means:

running said magnet wire from said end segment in tension from said magnet wire securement means to and along a first portion of said guide means that extends across a first portion of said electric terminal mounting means to said one face of said flange, thence winding said magnet wire in tensioned convolutions onto said core to create an electromagnet coil, thence running said magnet wire in tension from said coil to and along a second portion of said guide means extending from said one face of said flange across a second portion of said electric terminal mounting means, and thence running and securing said magnet wire in tension to said magnet wire securement means, and in which said bobbin includes at least one post disposed on said other face of said flange, and further including a ferromagnetic pole piece having a radial flange with a through-hole pattern corresponding to that of said at least one post, and further including the steps of disposing said flanges together so that said at least one post projects through the through-hole pattern in said pole piece flange, and deforming said at least one post to create a mushroom head that secures said flanges together.

32. A method of making an electromagnetic device comprising:

providing a length of insulated electric wire and structure on which the wire is to be disposed, wherein the structure comprises a coil-receiving portion, a wall defining a socket having an open axial end for accepting an electric terminal that is to make electric contact with the wire, wire guides mutually aligned transversely across the socket, and a wire securement which is disposed on the structure in spaced relation to the socket wall;

winding in tension on the coil-receiving portion an intermediate segment of the length of wire as an electromagnetic coil that terminates in end segments of the length of wire;

running one of the wire end segments in tension from the coil through the wire guides to transversely span the socket, running the one wire end segment in tension along a straight line from one of the wire guides to the wire securement, and securing the one wire end segment to the wire securement.

* * * * *